US009217243B2

(12) United States Patent
Gwen

(10) Patent No.: US 9,217,243 B2
(45) Date of Patent: Dec. 22, 2015

(54) DRAIN CLEANING TOOL

(71) Applicant: Patrick Gwen, Houston, TX (US)

(72) Inventor: Patrick Gwen, Houston, TX (US)

( * ) Notice: Subject to any disclaimer, the term of this patent is extended or adjusted under 35 U.S.C. 154(b) by 428 days.

(21) Appl. No.: 13/886,171

(22) Filed: May 2, 2013

(65) Prior Publication Data

US 2014/0325747 A1 Nov. 6, 2014

(51) Int. Cl.
*E03D 9/00* (2006.01)
*E03C 1/302* (2006.01)

(52) U.S. Cl.
CPC ..... *E03C 1/302* (2013.01)

(58) Field of Classification Search
CPC ..... E03C 1/302
See application file for complete search history.

(56) References Cited

U.S. PATENT DOCUMENTS 6,775,873 B2 * 8/2004 Luoma ..... E03C 1/302 15/104.001
7,610,635 B2 11/2009 Schultz
D610,761 S 2/2010 Gengler
D625,058 S 10/2010 Kovach
8,365,337 B2 * 2/2013 Tash ..... E03C 1/302 15/104.001

OTHER PUBLICATIONS www.amazon.com/Cobra-00412BL-Zip-It/dp/B002YFVFSU, web advertisement for "Cobra Zip-It", printed Apr. 30, 2013.

* cited by examiner

*Primary Examiner* — Tuan N Nguyen
(74) *Attorney, Agent, or Firm* — Andrew W. Chu; Craft Chu PLLC

(57) ABSTRACT

The tool for cleaning a drain includes a handle, a strip member, and an end piece. The handle inserts and removes the tool from the drain. The strip member has an elongated and undulated shape and is formed by segments. Each segment has a curvature with a concave side and convex side, which alternate from adjacent segments. Each segment also has barbs on each concave side. The barbs are shielded by an adjacent convex side of an adjacent segment. The end piece connects to a bottom segment of the strip member and has a collar and tip. The collar has a protective shoulder to shield barbs of the bottom segment and an actuatable spike to collect debris when bent. The tip has a distal point with prongs and a distal shoulder, which shields the prongs. The tip may also include a shaft with shaft barbs protected by a shaft shoulder.

20 Claims, 2 Drawing Sheets

DRAIN CLEANING TOOL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a tool for cleaning a drain. More particularly, the present invention relates to a tool for manually removing a clog or blockage in a plumbing pipe. The present invention further relates to a tool for clearing a drain by insertion and withdrawal of the tool into a pipe.

2. Description of Related Art Including Information Disclosed Under 37 CFR 1.97 and 37 CFR 1.98.

Clogged drains can lead to messy and embarrassing situations. Depending upon the severity of the clog, there are a variety of mechanical implements that can be used to clear drains. A plunger is the most common tool used to unclog a blockage in a pipe. The plunger includes a shaft and a rubber cup at one end of the shaft. The free end of the shaft is the handle, used to place the plunger into position. The cup is positioned to cover the mouth of the drain in the water. Using the handle, the cup is pushed towards the drain. Air in the cup is forced into the drain to break the clog, while the cup is flattened. Using the handle again, the cup is pulled into its original shape, causing a vacuum. The vacuum also acts to loosen or break the clog. The air push and the vacuum pull work to clear the clog or other blockage in the drain. The plunger can be used on other drains besides a toilet drain, such as a sink drain or bath tub drain.

Another mechanical implement is the plumber's snake. This device is a flexible coil with an auger end, which is inserted into the drain to physically contact and displace the clog or blockage. The plumber's snake normally includes a coiled metal wire with an auger end and a crank attached to the metal wire. The crank rotates the metal wire as the plumber's snake enters the drain. The auger end has screw threads for boring into a clog. The combination of the rotation of the wire and the boring action of the auger end results in clearing a clog or blockage. There is the corkscrew action of the auger end to dig into the clog. The clog can be pulled out of the drain with the auger end anchored into the clog. There is the rupture of the clog with the snake drilling through the blockage, allowing some fluid to pass through the clog to break down the clog. Additionally, the mechanical action of rubbing the auger end and the coil against the blockage loosens and breaks the clog.

Another mechanical tool is the auger strip, which includes an elongated flexible strip for insertion directly into the drain pipe. The strip has a length to physically reach the clog, and barbs are located along the length of the strip. The tip of the strip punctures, rubs, twists, and engages the clog for removal. The barbs scrap and impale the clog or other clogging fragments along the length of the drain pipe. The clog and fragments are snagged on the strip, and the strip is removed from the pipe by pulling the handle end from the drain. The snagged clog and fragments are removed from the pipe along with the strip.

The plunger is not always effective against all clogs, especially more serious clogs and blockages. The auger strip is not effective for sweeping the sides of the pipe, and the barbs are easily broken. The plumber's snake is usually reserved for particularly difficult clogs, and there are professional services with technically advanced and strongly powered versions of the plumber's snake. These advanced services are costly and disruptive. There is a need for another type of device to be effective against clogs that cannot be cleared by either the prior art plunger or the auger strip, while being more easy to use, efficient and less costly than the plumber's snake.

It is an object of the present invention to provide a tool for cleaning a drain.

It is another object of the present invention to provide embodiments of a drain cleaning tool with a specialized tip for breaking clogs.

It is another object of the present invention to provide embodiments of the drain cleaning tool with improved barb elements.

It is another object of the present invention to provide embodiments of the drain cleaning tool with retractable spike elements.

It is another object of the present invention to provide embodiments of the drain cleaning tool with a protect means for the barbs and spikes.

It is still another object of the present invention to provide embodiments of the drain cleaning tool with an undulated strip.

It is still another object of the present invention to provide embodiments of the drain cleaning tool with an undulated strip with barbs in concave sections.

It is yet another object of the present invention to provide embodiments of the drain cleaning tool with an ergonomic handle for insertion and removal of the tool.

These and other objectives and advantages of the present invention will become apparent from a reading of the attached specifications and appended claims.

SUMMARY OF THE INVENTION

Embodiments of the present invention include the tool for cleaning a drain comprised of a handle, a strip member, and an end piece. The tool can be inserted into a drain with a clog so that the handle can be used to push the end piece through the drain to directly engage the clog. Puncturing and scraping through the drain pipe, debris and clog materials are released and snagged by the tool. The strip member and end piece collect the debris and clog materials for removal. Other debris and clog material may wash freely through the pipe with the drain running without blockage.

The handle has a finger grip to facilitate grasping by the user for the insertion and removal action to and from the drain.

Embodiments of the strip member have an elongated and undulated shape to increase the contact with the interior of the pipe as the tool snakes down the drain. The strip member is comprised of a plurality of segments. Each segment has a curvature, and each segment joins end to end to each other to form the strip member. The curvatures of adjacent segments alternate, so that the undulate shape is formed by the joined segments and curvatures. Additionally, each segment is comprised of a plurality of barbs on the curvature. The curvature can have a concave side and convex side, and the barbs can be placed on the concave side, the convex side or both. When the barbs on the concave side, the barbs are shielded by an adjacent convex side of an adjacent segment, when the tool is pulled from the drain.

Embodiments of the end piece connect to a bottom segment of the strip member. The end piece is the direct contact on the clog. There is a collar and tip. The collar has a protective shoulder to shield barbs of the bottom segment. Optionally, the collar has an actuatable spike. When passing through straight pipe, the actuatable spike is in a retracted position. When passing through a pipe elbow or other bending of the collar, the actuatable spike is in an extending position. In the extending position, the spike can snag and hold debris and clog material. When the collar returns to a neutral position in straight pipe, the spike clamps and holds the debris and clog material in place for removal from the drain.

In some embodiments, the tip of the end piece is comprised of a distal point with a plurality of prongs and a distal shoulder. The distal point is the very end of the tool for puncturing and scraping the clog. As such, the concentration of the plurality of prongs is greater than concentration of the plurality of barbs on each segment. The distal point must hold more clog material than along the length of the tool. Similar to the convex side, the distal shoulder shields the prongs by extending beyond ends of each prong. The tip may also include a shaft extending from the tip to the collar. There are shaft barbs and shaft shoulder to add additional puncturing elements to the end piece for increased snagging and capturing ability where the clog requires at the end piece of the tool.

DETAILED DESCRIPTION OF THE DRAWINGS

Figure 1:
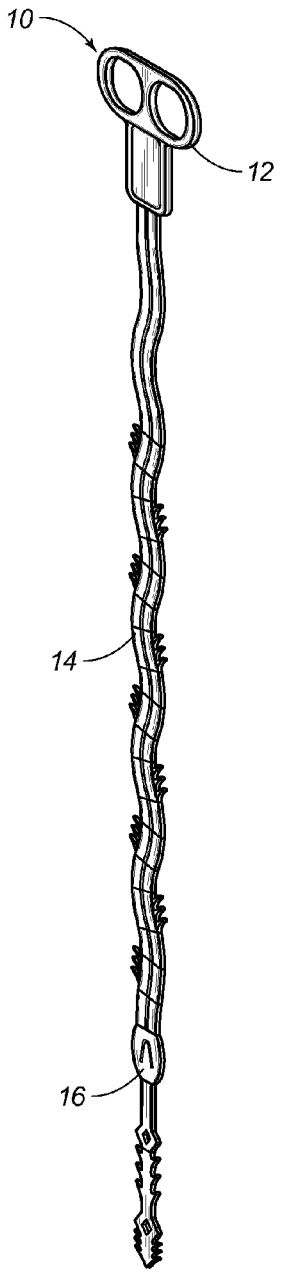
FIG. 1 is an upper perspective view of an embodiment of the tool for cleaning a drain according to the present invention.
Figure 2:
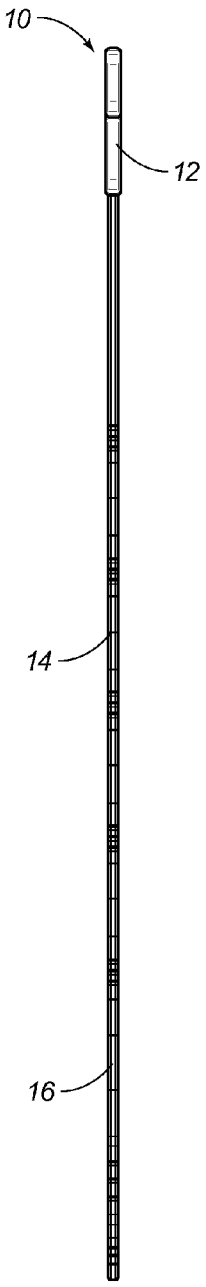
FIG. 2 is a side elevation view of an embodiment of the tool for cleaning a drain according to the present invention.
Figure 3:
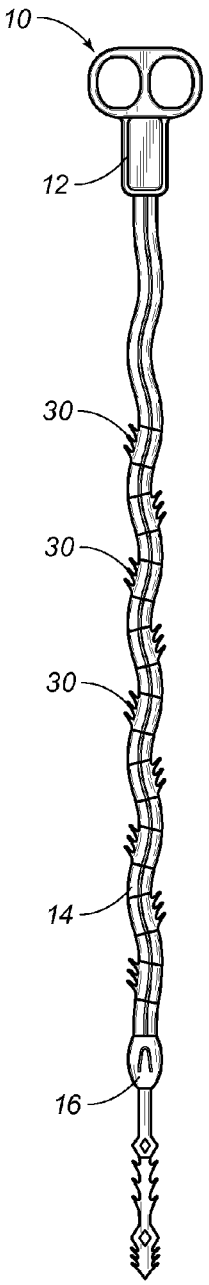
FIG. 3 is a front elevation view of an embodiment of the tool for cleaning a drain according to the present invention.

Referring to FIGS. 1-3, embodiments of the tool 10 for cleaning a drain of the present invention include a handle 12, a strip member 14, and an end piece 16. The tool 10 is inserted into a clogged drain, using the handle 12 to push through the length of the tool 10. The end piece 16 enters the drain and travels through the pipe to reach the clog. The end piece 16 engages the clog by puncturing or scraping. The clog is dislodged by the action of the end piece 16 as controlled by the handle 12. The clog material can become attached to the end piece 16 or flow down the pipe. The strip member 14 snakes through the pipe, scraping and rubbing to remove deposits. The deposits and some clog material can also become attached to the strip member 14. As the handle 12 is pulled upward from the drain, the clog material and debris are physically removed from the drain because of attachment to the tool 10. The strip member 14 and the end piece 16 require protection so that the clog material and debris is not dislodged when removed from the drain. The bending through pipes and force of the water may affect the capture ability of the tool 10.

Figure 4:
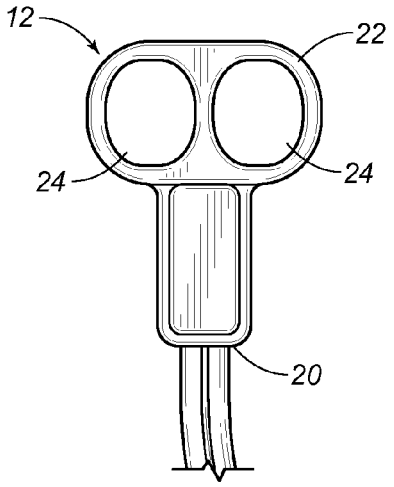
FIG. 4 is an isolated front elevation view of an embodiment of the handle of the tool according to the present invention.

Embodiments of the handle 12 of the tool 10 have an attachment end 20 and a pulling end 22. The pulling end 22 has finger grips for the user. In some embodiments, the finger grips are two holes 24 for insertion of the user's fingers. The holes 24 can be easily and efficient grasped for insertion of the tool 10 into the drain and removal of the tool 10 with the debris and clog material from the drain. FIG. 4 shows an exploded view of the handle 12. The attachment end 20 connects to the strip member 12, and the connection can be any known method of attachment, including being made integral with the strip member 12.

Figure 5:
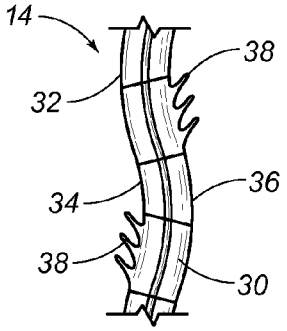
FIG. 5 is an isolated front elevation view of an embodiment of segments of the strip member of the tool according to the present invention.

Embodiments of the strip member 14 have an elongated and undulated shape. In some versions as shown in FIG. 5, the strip member 14 is comprised of a plurality of segments 30. Each segment 30 has a curvature 32. The curvatures 32 alternate orientation from segment 30 to segment 30. The segments 30 are joined end to end to each other to form the elongated and undulated shape of the strip member 14. Each segment 30 also has a plurality of barbs 38 on a respective curvature 32. Each curvature 32 can have a concave side 34 and convex side 36, and the barbs 38 can be placed on the concave side 34 or the convex side 36. The barbs are placed in close proximity to each other. The two or more barbs are within 0-5 mm away from each other in some embodiments.

FIG. 5 shows the barbs 38 on the concave side 34. The barbs 38 are also oriented in a direction of insertion of the strip member 14, and there is a top segment 30 connecting to the attachment end 20 of the handle 12. In the present invention, when the plurality of barbs 38 is placed on a concave side 34, these barbs 38 are shielded by an adjacent convex side 36 of an adjacent segment 30 as shown in FIG. 5.

Snaking into the drain, a lower convex side 36 of a lower adjacent segment 30 protects the barbs 38 from being broken or damaged. Retracting back through the drain, an upper convex side 36 of an upper adjacent segment 30 protects the barbs 38 from breakage, which also maintains the trapped debris and clog materials on the strip member 14. Additionally, the undulations sweep a wider swath through the pipe, scraping and contacting more sides of the pipe than prior art devices.

Figure 6:
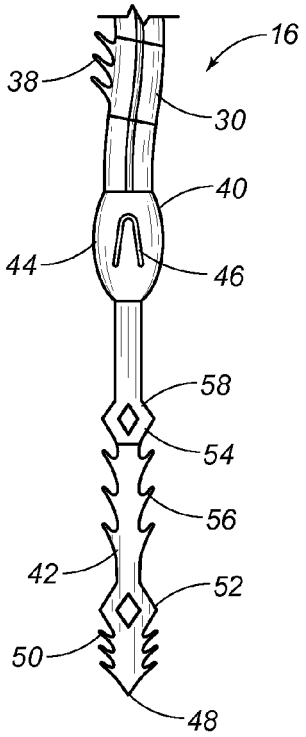
FIG. 6 is an isolated front elevation view of an embodiment of the end piece of the tool according to the present invention grill.

Referring to FIG. 6, embodiments of the end piece 16 of the present invent connect to a bottom segment 30 of the strip member 14 on an opposite end of the strip member 14 from the handle 12. The end of the strip member 14 becomes the connection point for the end piece 16, which directly engages the clog material. The end piece 16 has a collar 40 and tip 42. The collar 40 includes a protective shoulder 44. The protective shoulder 44 is a convex surface shielding barbs 38 of the bottom segment 30. FIG. 6 shows the convex surface at the same length as the barbs 38. In some embodiments, as shown in FIG. 6, the collar 40 has an actuatable spike 46. FIG. 6 shows the actuatable spike 46 in a retracted position when the collar 40 is in a neutral state. When the collar 40 is bent, such as passing through a pipe elbow, the actuatable spike 46 is set in an extending position. The extending position allows the actuatable spike 46 to snag clog material and debris. When the end piece 16 enters a straight portion of pipe, the actuatable spike 46 retracts back to the collar 40, while clamping the debris and clog materials. Thus, the actuatable spike 46 further enhances the removal of the clog and cleaning of the drain.

The embodiments of the tip 42, as shown in FIG. 6, is comprised of a distal point 48 with a plurality of prongs 50 and a distal shoulder 52. The distal point 48 is the very tip of the tip 42, farthest from the handle 12 of the tool 10. The distal point 48 punctures the clog and impales the clog material. The plurality of prongs 50 impale the clog materials or drill through the clog. The concentration of the plurality of prongs 50 at the distal point 48 is greater than concentration of the plurality of barbs 38 on each segment 30. The prongs 50 must be able to more stably engage the clog directly, so more puncture elements are needed at the tip 42. The distal shoulder 52 shields the plurality of prongs 50, similar to the convex side 36 shielding the barbs 38. The distal shoulder 52 extends beyond ends of each prong 50 so that prongs 50 have less risk of damage during the removal of the tool 10 from the drain.

In another option shown in FIG. 6, the tip 42 also has a shaft 54 extending from the distal shoulder 52 to the collar 40. The shaft 54 adds length to the end piece 16 and further concentrates puncturing elements from the strip member 14. The shaft 54 can have a plurality of shaft barbs 56 distributed along a length of the shaft 54, and a shaft shoulder 58 between the plurality of shaft barbs 56 and the collar 40. Similar to the convex side 36 of the segment 30, and the distal shoulder 52 of the distal point 48, the shaft shoulder 58 shields the shaft barbs 56 from damage. The shaft barbs 56 are no longer exposed to scraping and rubbing to loosen and release clog material and debris from the tool 10. The shaft 54 further supports the improved snagging and retention by the tool 10 of the present invention. The orientation of the shaft barbs 56, barbs 38, and the prongs 50 can basically be the same with different concentrations and angles, but all protrusions insert into the drain and avoid damage when removed from the drain.

Embodiments of the present invention, as shown in FIGS. 1-6, show versions of a tool for cleaning a drain with superior structures and innovations beyond the prior art. The handle has a gripping structure for more ergonomic, easy and reliable control by the user. The grasping action is facilitated by the two holes in the handle. The strip member has an innovative undulated shape for improved scraping and coverage through the length of the pipe to be cleaned. The barbs are placed in patches of close proximity for more effective capture of debris. When barbs are placed on the convex side of the curvature, the reach of the barbs is increased for snagging and trapping debris and clog materials. When the barbs are placed on the concave side of the curvature, the barbs are protected from damage with the concave placement and convex shielding by adjacent segments. The undulations protect the functionality of the barbs in addition to the extra coverage of the interior of the pipe. The curvature of the strip member covers more area as the tool rotates, twists, and screws through the pipe.

There is more cleaning action than just the tip. The end piece has a specialized tip for breaking clogs with a better concentration of prongs. The snagging of the clog material, scraping of the clog, puncturing of the clog, and removal of the clog is enhanced by the end piece of the present invention. Additionally, the snagging efficacy is increased by the actuatable spikes. The clamping of debris and/or clog material aids in the capture and removal of clog materials. Furthermore, the shoulders for shielding puncturing elements are repeated for the prongs and spikes. The actuatable spike is retracted for protection, while the prongs and barbs are shielded by concave sides or shoulders. The protection increases the working life of the tool and affects the efficacy of this mechanical tool 10 to clean and remove as much as possible. The embodiments of the present invention more effectively snag debris and clog material and more effectively remove the debris and clog material on the tool.

The foregoing disclosure and description of the invention is illustrative and explanatory thereof. Various changes in the details of the illustrated structures, construction and method can be made without departing from the true spirit of the invention.

I claim:

1. A tool for cleaning a drain, comprising:

a handle with an attachment end and a pulling end, wherein said pulling end has finger grips;

a strip member having an elongated and undulated shape, said strip member being comprised of a plurality of segments, wherein a top segment connects to said attachment end of said handle, wherein each segment has a curvature, each segment being joined end to end to each other to form said strip member, wherein curvatures of adjacent segments alternate, and wherein each segment is comprised of a plurality of barbs on said curvature; and an end piece connected to a bottom segment of said strip member, said end piece having a collar and tip and being positioned on an opposite end of said strip member from said handle.

2. The tool for cleaning a drain, according to claim 1, wherein said pulling end has two holes.

3. The tool for cleaning a drain, according to claim 1, wherein each segment has a curvature with a concave side and convex side, and wherein said barbs are placed on said concave side and shielded by an adjacent convex side of an adjacent segment.

4. The tool for cleaning a drain, according to claim 1, wherein each segment has a curvature with a concave side and convex side, and wherein said barbs are placed on said convex side.

5. The tool for cleaning a drain, according to claim 1, wherein said collar has a protective shoulder, said protective shoulder being a convex surface shielding barbs of said bottom segment.

6. The tool for cleaning a drain, according to claim 5, wherein said collar has an actuatable spike, said actuatable spike being in a retracted position when said collar is in a neutral state, and said actuatable spike being in an extending position when said collar is in a bended state.

7. The tool for cleaning a drain, according to claim 1, wherein said tip is comprised of a distal point with a plurality of prongs and a distal shoulder, and wherein said distal shoulder shields said plurality of prongs, extending beyond ends of each prong.

8. The tool for cleaning a drain, according to claim 7, wherein concentration of said plurality of prongs is greater than concentration of said plurality of barbs on each segment.

9. The tool for cleaning a drain, according to claim 1, wherein said tip is comprised of a shaft extending from said tip to said collar, said shaft being comprised of a plurality of shaft barbs distributed along a length of said shaft, and a shaft shoulder between said plurality of shaft barbs and said collar, wherein said shaft shoulder shields said plurality of shaft barbs.

10. A tool for cleaning a drain, comprising:

a handle with an attachment end and a pulling end, wherein said pulling end has finger grips;

a strip member being comprised of a plurality of segments, wherein a top segment connects to said attachment end of said handle, and wherein each segment is comprised of a plurality of barbs; and an end piece connected to a bottom segment of said strip member, said end piece having a collar and tip and being positioned on an opposite end of said strip member from said handle, wherein said collar has a protective shoulder, said protective shoulder being a convex surface shielding barbs of said bottom segment, wherein said tip is comprised of a distal point with a plurality of prongs and a distal shoulder, wherein concentration of said plurality of prongs is greater than concentration of said plurality of barbs on each segment, and wherein said distal shoulder shields said plurality of prongs, extending beyond ends of each prong.

11. The tool for cleaning a drain, according to claim 10, wherein said collar has an actuatable spike, said actuatable spike being in a retracted position when said collar is in a neutral state, and said actuatable spike being in an extending position when said collar is in a bended state.

12. The tool for cleaning a drain, according to claim 10, wherein said tip is further comprised of a shaft extending from said distal shoulder to said collar, said shaft being comprised of a plurality of shaft barbs distributed along a length of said shaft, and a shaft shoulder between said plurality of shaft barbs and said collar, wherein said shaft shoulder shields said plurality of shaft barbs.

13. The tool for cleaning a drain, according to claim 10, wherein strip member has an elongated and undulated shape, wherein each segment has a curvature, each segment being joined end to end to each other to form said strip member, and wherein curvatures of adjacent segments alternate.

14. The tool for cleaning a drain, according to claim 10, wherein each segment is comprised of a plurality of barbs on said curvature in close proximity, and wherein each curvature has a concave side and a convex side.

15. The tool for cleaning a drain, according to claim 14, wherein said barbs on placed on a concave side, said barbs being shielded by an adjacent convex side of an adjacent segment.

16. The tool for cleaning a drain, according to claim 14, wherein said barbs on placed on a convex side.

17. A tool for cleaning a drain, comprising:

a handle with an attachment end and a pulling end, wherein said pulling end has finger grips;

a strip member having an elongated and undulated shape, said strip member being comprised of a plurality of segments, wherein a top segment connects to said attachment end of said handle, wherein each segment has a curvature, each segment being joined end to end to each other to form said strip member, wherein curvatures of adjacent segments alternate, and wherein each segment is comprised of a plurality of barbs on said curvature; and an end piece connected to a bottom segment of said strip member, said end piece having a collar and tip and being positioned on an opposite end of said strip member from said handle, wherein said collar has a protective shoulder, said protective shoulder being a convex surface shielding barbs of said bottom segment.

18. The tool for cleaning a drain, according to claim 17, wherein each segment has a curvature with a concave side and convex side, and wherein said barbs are placed on said concave side and shielded by an adjacent convex side of an adjacent segment.

19. The tool for cleaning a drain, according to claim 1, wherein each segment has a curvature with a concave side and convex side, and wherein said barbs are placed on said convex side.

20. The tool for cleaning a drain, according to claim 17, wherein said collar has an actuatable spike, said actuatable spike being in a retracted position when said collar is in a neutral state, and said actuatable spike being in an extending position when said collar is in a bended state.

* * * * *